US007270066B2

(12) United States Patent
Kulikov et al.

(10) Patent No.: US 7,270,066 B2
(45) Date of Patent: Sep. 18, 2007

(54) ICE BREAKER (VARIANTS), METHOD AND SYSTEM FOR SINGLE-SUPPORT MOORING AND SERVICING SHIPS

(75) Inventors: Nikolai Vladimirovich Kulikov, Moscow (RU); Vyacheslav Vladimirovich Ruksha, Moscow (RU)

(73) Assignee: Murmansk Shipping Company, Joint Stock Company, Murmansk (RU)

( * ) Notice: Subject to any disclaimer, the term of this patent is extended or adjusted under 35 U.S.C. 154(b) by 217 days.

(21) Appl. No.: 10/517,008

(22) PCT Filed: Dec. 2, 2002

(86) PCT No.: PCT/RU02/00515

§ 371 (c)(1),
(2), (4) Date: Aug. 4, 2005

(87) PCT Pub. No.: WO03/104286

PCT Pub. Date: Dec. 18, 2003

(65) Prior Publication Data

US 2006/0096513 A1 May 11, 2006

(30) Foreign Application Priority Data

Jun. 6, 2002 (RU) ..... 2002114906

(51) Int. Cl.
*B63B 35/08* (2006.01)

(52) U.S. Cl. ..... 114/40; 114/293; 441/3; 441/4

(58) Field of Classification Search ..... 114/40, 114/293; 441/3, 4

See application file for complete search history.

(56) References Cited

U.S. PATENT DOCUMENTS 3,455,270 A 7/1969 Mascenik et al. ..... 114/230.15

(Continued)

FOREIGN PATENT DOCUMENTS

| | | |
|---|---|---|
| RU | 2133687 | 7/1999 |
| SU | 1106730 | 8/1984 |

*Primary Examiner*—Stephen Avila
(74) *Attorney, Agent, or Firm*—patenttm.us

(57) ABSTRACT

To ensure the possibility of offshore shipping of a liquid medium, primarily oil, from an onshore tank farm into sea-going tankers in the winter time in the ice conditions by ensuring both mooring to an offshore terminal and single-point mooring of a tanker at any time, without depending on the dominating wind and sea condition, in a direction most convenient for it with the possibility of its roundabout turning, with the subsequent servicing of it by transporting a liquid medium into such a tanker the following transformations have been made:

a known ice breaker (1) is provided with: a diving station (5) installed on its deck (3), the diving station being provided with a diving trunk (6) made in the hull (2) of the ice-breaker (1), a device for the protection of a flexible hose (8) of an underwater pipeline against ice action, the device being made, according to the first embodiment, in the form of a cylinder (7) provided with guides (13) for moving in a guiding trunk (10) made in the stern side of the hull (2). According to the second embodiment the ice-breaker (1) is provided with a device for the protection of the flexible hose (8) of the underwater pipeline against ice action, the device being made in the form of a pontoon (15) provided with a trunk (16) for servicing the flexible hose (8) and installed in the travel position on the deck (4);

a system of single-point mooring and servicing of ships is provided with the ice-breaker (1), which is claimed as an invention, for ensuring offshore shipping of oil, a mooring line and a hose for transporting a liquid medium are made as a single hose-mooring line (28); a method of single-point mooring and servicing of ships, primarily tankers (9) is carried out with the use of the claimed ice-breaker (1) and the hose-mooring line (28).

14 Claims, 12 Drawing Sheets

U.S. PATENT DOCUMENTS 3,973,509 A 8/1976 Waas ..... 114/42
4,433,941 A * 2/1984 Gerwick et al. ..... 405/211
4,604,961 A * 8/1986 Ortloff et al. ..... 114/230.12
5,224,800 A * 7/1993 Mogridge et al. ..... 405/211
5,380,229 A * 1/1995 Korsgaard ..... 441/3
5,431,589 A * 7/1995 Corona ..... 441/4
5,647,295 A * 7/1997 Korsgaard ..... 114/230.1

* cited by examiner

ICE BREAKER (VARIANTS), METHOD AND SYSTEM FOR SINGLE-SUPPORT MOORING AND SERVICING SHIPS

This invention relates to ship-building and may be used in post-equipping ice-breakers for the purpose of offshore loading of a liquid medium, primarily oil, into tankers in the winter time in the ice conditions.

The invention also relates to methods and devices for single-point mooring of ships, primarily tankers, and the possibility of loading them with a liquid medium, primarily oil, in the winter time in the ice conditions with the use of the claimed ice-breaker.

At present, due to an increase in oil consumption, its production at off-shore fields both abroad and in the Russian Federation (the Kara Sea, the Barents Sea) has becoming more intensive. Thus, in the Russian Federation, in the Timano-Pechora Province rich oil fields have been discovered. Severe climatic conditions are typical for this province: the cold winter period with negative temperatures and ice formation on the sea lasts from November till May. Such climatic conditions put forward new requirements to systems for transferring oil from land into a tanker, which should be able to ship oil not only in the short warm period, but also during the long cold period of time.

Known in the art is a ship for ice navigation, comprising a hull with the double bottom and double sides, an ice-breaking stem, stern propellers, a propulsion and steering complex of water-jet type having side water passages in communication with the outboard water area, the said complex being installed in the ship forebody and arranged in an elongated extension (see USSR Inventor's Certificate No. 1309473 for the invention "A ship for ice navigation". IPC B63B 35/08. Application No. 3964759/27-11, priority date as of Sep. 17, 1985. Published on Oct. 23, 1988, Off. Bull. No. 39. Inventors —A. V. Pilipenko, Ye. M. Novoseltsev), [1].

In order to load floating objects with heavy cargoes, sluice valves are opened and outboard water freely comes into the hold until the time when its level reaches the existing waterline. The floating objects are moved to the hold, the gate is closed and the water is pumped out of the hold.

The said ship enables to lead cargoes, namely floating objects with bulk cargoes. The ship is very complex and non-fit for shipping a liquid medium.

On the basis of an analysis of information on the state of the art in this field, the closest, from among the known ice-breakers, is the ice-breaker comprising the hull having vertical through guiding trunks and the deck (see USSR Inventor's Certificate No. 1106730 for the invention "An ice-breaker". IPC B63B 35/08, priority date as of Apr. 7, 1982, Application No. 3419886/27-11, published on Aug. 7, 1984, Off. Bull. No. 29—a prototype) [2].

The said ice-breaker performs only its main functions—breaking the ice cover for making the way (passage) for other ships and providing them with necessary assistance when moving in ice, as well as navigates independently.

The vertical through guiding trunks, as made in the hull of the known ice-breaker, are intended for guiding devices additionally breaking the ice cover.

Thus, the analysis of the found information on the state of the art has shown that the existing ice-breakers perform, principally, their main functions—breaking of the ice cover and piloting ships in the ice conditions.

Known in the art is a method of mooring and servicing ships, according to which an annular mooring recess, as made in the lower part of the ship's hull, a mooring member coupled by its upper part with the said recess and connected by a plurality of ropes holding the said member at a pre-determined depth, a device for lifting the mooring member, a device for quickly admitting water into the ship's hull through input holes, as located inside the said recess, are used (see RF Patent No. 2146633 for the invention "A ship mooring system". IPC B63B 22/02, Application No. 95113430/28 with the priority date as of Dec. 29, 1993. Published on Mar. 20, 2000. Applicant—Jens Korsgord (DK) [3].

The said method of mooring is rather complex; it does not ensure sufficient maneuverability of a moored ship. The requirements to the offshore work safety when mooring and loading oil are not complied with. Furthermore, the said method is absolutely not applicable in the ice conditions.

An analysis of the information selected during a search in this field has enabled to identify the closest method of single-point mooring of ships, preferably tankers, according to which for transporting a liquid medium into a moored tanker or out of it a fixed construction secured to the sea bed, the mooring chain of a tanker and at least one flexible pipeline are used; forward and rotational movements of a tanker are compensated by turns of interconnected members, one of which is supported by the said fixed construction secured to the sea bed, and the mooring chain of a tanker and a flexible pipeline for transporting a liquid medium into a tanker or out of it are connected to another member (see RF Patent No. 2133687 for the invention "A method of single-point mooring of ships and a system for carrying out same (embodiments). IPC B63B 22/02. Application No. 97104654/18 with the priority date as of Mar. 20, 1997. Published on Jul. 27, 1999. Applicant—Tecnomare S. p. A. (Italy)—a prototype) [4].

The said method is suitable for offshore single-point mooring of a ship, ensures positioning, at any time depending on the dominating wind and sea condition, of a moored tanker in a direction most convenient for it with the possibility of its roundabout turning and positioning by its bow downwind. But the said method is not sufficiently secure due to the possible twisting of the mooring chain and the flexible pipeline, which go in parallel, in the process of a tanker's turns.

Known in the art is a system of mooring ships, comprising an annular mooring recess, as made in the lower part of the ship's hull, a mooring member coupled by its upper part with the said recess and connected by a plurality of ropes holding the said member at a pre-determined depth, a device for lifting the mooring member, a device for quickly admitting water into the ship's hull through input holes, as located inside the said recess, see [3].

The said system of mooring is rather complex, does not ensure sufficient maneuverability of a moored ship, does not ensures safety of mooring and oil shipping operations, is not suitable for using in the ice conditions.

On the basis of an analysis of the information on the state of the art in this field, from among the known systems the closest is the system of single-point mooring of ships, preferably tankers, comprising a fixed construction secured to the sea bed, the mooring chain of a tanker and at least one flexible pipeline; a toroidal device connected to the said fixed construction, a yoke, the tips of the bifurcated part of which are connected to the said toroidal device with the possibility of turning the said yoke around the horizontal axis (turning axis) and the second end of the yoke is connected to the mooring chain of a tanker—a prototype, see [4].

The said system is suitable for offshore single-point mooring of a ship, ensures positioning, at any time depending on the dominating wind and sea condition, of a moored tanker in a direction most convenient for it with the possibility of its roundabout turning and positioning by its bow downwind. But the said system is not suitable for mooring and servicing tankers in the ice conditions. Furthermore, the system is insufficiently secure due to the possible twisting of the mooring chain and the flexible pipeline in the process of the tanker's turns.

Thus, the analysis of the found information on the state of the art has shown that the existing methods and systems of single-point mooring and servicing of takers do not enable to perform mooring and transporting oil into a tanker in the winter time in the ice conditions.

The claimed group of inventions ("An ice-breaker (embodiments), a method and a system of single-point mooring and servicing of ships") enables to obtain a new technical result—the possibility of offshore shipping of a liquid medium, primarily oil, from an onshore tank farm into sea-going tankers in the winter time in the ice conditions by ensuring both mooring to an offshore terminal and single-point mooring of a tanker at any time, without depending on the dominating wind and sea condition, in a direction most convenient for it with the possibility of its roundabout turning, with the subsequent servicing of it by transporting a liquid medium into such a tanker.

The below-stated totality of essential features characterizes the essence of the claimed group of inventions and helps to achieve a new technical result.

First Embodiment of the Ice-Breaker

An ice-breaker, primarily for carrying out offshore transportation of a liquid medium, preferably oil, comprising the hull with vertical through guiding trunks and the deck, characterized in that it is equipped with a diving station installed on the deck and communicating with one of the said vertical through trunks, which is intended for lowering and raising a diver, a device for the protection of a flexible hose of an underwater pipeline against ice action, which is made in the form of a cylinder provided with guides for moving in another vertical trunk made in the stem side of the hull and installed in its travel position on the afterdeck.

A technical result is also achieved due to the fact that the said ice-breaker is equipped with cargo lowering and lifting mechanisms and a towing device.

A technical result is also achieved due to the fact that the ice-breaker is equipped with a container, which is installed on the deck and contains oil gathering equipment and fire-fighting means.

A technical result is also achieved due to the fact that the ice-breaker is equipped with a removable platform, which is installed on the afterdeck and has a container for gathering oil spills and an ecological monitoring laboratory.

Second Embodiment of the Ice-Breaker

An ice-breaker, primarily for carrying out offshore transportation of a liquid medium, preferably oil, comprising the hull with a vertical through guiding trunk and the deck, characterized in that it is equipped with a diving station installed on the deck and communicating with the said vertical through trunk, which is intended for lowering and raising a diver, a device for the protection of a flexible hose of an underwater pipeline against ice influence, which is made in the form of a pontoon having a trunk for servicing of the flexible hose and installed in its travel position on the deck.

A technical result is also achieved due to the fact that the said ice-breaker is equipped with cargo lowering and lifting mechanisms and a towing device.

A technical result is also achieved due to the fact that the ice-breaker is equipped with a container, which is installed on the deck and contains oil gathering equipment and fire-fighting means.

A technical result is also achieved due to the fact that the ice-breaker is equipped with a removable platform, which is installed on the afterdeck and has a container for gathering oil spills and an ecological monitoring laboratory.

A method of single-point mooring of ships, primarily tankers in the ice conditions, according to which a fixed construction secured to the sea bed is used, the said construction being provided with a device being connected to it with the possibility of turning around the vertical axis and a valve for a liquid medium, primarily oil, a mooring line and a flexible pipeline for transporting a liquid medium into a moored tanker through the cargo-receiving device of the tanker, characterized in that for mooring a tanker and transporting a liquid medium a mooring line and a hose, which are made as a single hose-mooring line which bitter end is secured on the fixed construction device, are used, an ice-breaker ensuring offshore shipping of oil is additionally used, which has a diving station installed on the deck and communicating with a trunk for lowering and raising a diver, who opens the valve for a liquid medium, finds the hose-mooring line and raises it to the tanker after emergency detachment of it from the cargo-receiving device of the tanker in the conditions of close and drifting ice.

The achievement of a technical result is also supported by that a weight is attached to and a damper, which is made, preferably, in the form of a cable and connected on one its end with the device of the fixed construction and on the other end with the said weight, is installed on a section of the hose-mooring line near its bitter end.

The technical result is achieved also due to the fact that the section of the hose-mooring line, which is located between the device of the fixed construction and the weight, is installed outside the area of action of power loads.

A system of single-point mooring of ships, primarily tankers in the ice conditions, comprising a fixed construction secured to the sea bed and having a device being connected to it with the possibility of turning around the vertical axis and a valve for a liquid medium, primarily oil, a mooring line and a flexible pipeline for transporting a liquid medium into a moored tanker through the cargo-receiving device of the tanker, characterized in that the mooring line and the hose for transporting a liquid medium are made as a single hose-mooring line which bitter end is secured on the fixed construction device; the system is provided with an ice-breaker ensuring offshore shipping of oil, which has a diving station installed on the deck and communicating with a trunk, arranged in the hull, for lowering and raising a diver, who opens the valve for a liquid medium, finds and raises the hose-mooring line after emergency detachment of it from the cargo-receiving device of the tanker in the conditions of close and drifting ice.

The achievement of a technical result is also supported by that the system is provided with a weight is attached to a section of the hose-mooring line near its bitter end and a damper, which is made, preferably, in the form of a cable and connected on one its end with the device of the fixed construction and on the other end with the said weight.

The technical result is achieved also due to the fact that the section of the hose-mooring line, which is located between the device of the fixed construction and the weight, is outside the area of action of power loads.

So, the analysis of the found information on the state of the art in the said fields and the essence of the claimed group of inventions have shown that the latter comply with the patentability criterion of novelty.

The provision of an ice-breaker comprising the hull with the vertical through guiding trunks made in it, and the deck, the diving station installed on the deck and connected with one of the vertical through trunks, which is intended to ensure lowering and raising a diver, enables to lower and raise a diver from the deck for conducting the necessary underwater works, namely: search on and raise of the flexible hose of the underwater pipeline from the sea bed, the works required for the preparation of the oil shipping system for the start-up.

The provision of an ice-breaker with a device for the protection of the flexible hose of the underwater pipeline against ice action, in particular, according to the first embodiment of the ice-breaker, with a device made in the form of a cylinder provided with guides for moving in the vertical trunk made in the stem side of the hull and installed in its travel position on the afterdeck prevents the flexible hose from being damaged by floating ice and protects it against bends during its raising from the sea bed onto the ice-breaker deck/lowering to the sea bed from the ice-breaker deck and in the course of oil loading into a tanker owing to movements of the flexible hose inside the cylinder. It contributes to the achievement of the stated technical result.

The provision of an ice-breaker, according to the 2nd embodiment, with a device for the protection of the flexible hose of the underwater pipeline against ice action, which is made in the form of a pontoon having a trunk for servicing the flexible hose installed in its travel position on the deck of the ice-breaker, also ensures the protection of the latter against finely broken ice during operations of raising the flexible hose from the sea bed onto the ice-breaker deck/lowering the flexible hose to the sea bed from the ice-breaker deck and in the course of oil loading into a tanker via the flexible hose in the winter time in the conditions of initial ice formation.

The provision of the ice-breaker with cargo lowering and lifting mechanisms enables to lower the pontoon on the water, to raise the flexible hose of the underwater pipeline and to transfer it from the ice-breaker to a tanker.

The provision of the ice-breaker with a towing device enables the ice-breaker to perform an additional function—to tow means of transportation, in particular a tanker, in a case of the latter's failure to move.

The provision of the ice-breaker with a container with oil gathering equipment and fire-fighting means, as installed on the deck, enables the ice-breaker to perform new functions in addition to the above indicated ones, namely: to localize emergency spills of oil and extinguish fires possible during loading oil into a tanker, which, in combination with the other features, contributes to the achievement of the stated result.

The provision of the ice-breaker with a removable platform with a container for collecting oil spills, as installed in the afterdeck, enables to collect possible spills of oil during its transportation, thus preventing the ice-breaker deck from becoming dirty and, consequently, the environment from being polluted.

The provision of the ice-breaker with an ecological monitoring laboratory also enables to perform the above-said function—preventing the environment in the area of oil shipping from being polluted.

Consequently, the ice-breaker claimed as an invention not only ensures the fulfillment of its direct functions, i.e., breaking the ice cover, but also assists in performing new functions, namely: salvage works in accident cases involving a tanker (failure to move, grounding, etc.), liquidation of emergency spills of oil, liquidation of fires, prevention of the environment in the area of oil transportation from being polluted (ecological monitoring).

Thus, the ice-breaker claimed as an invention, its new totality of essential features both according to the 1st and the 2nd embodiments enables to achieve a new technical result as well as to perform a number of new functions not peculiar to an ice-breaker, but necessary for achieving a technical result.

The method of single-point mooring and servicing of ships, primarily tankers, according to which a fixed construction secured to the sea bed is used, the said construction being provided with a device being connected to it with the possibility of turning around the vertical axis and a valve for a liquid medium, primarily oil, a mooring line and a flexible pipeline for transporting a liquid medium into a moored tanker through the cargo-receiving device of the tanker, ensures single-point mooring of tankers and their servicing for transporting a liquid medium offshore at any time, without depending on the dominating wind direction and sea condition, in a direction most convenient for it with the possibility of its roundabout turning.

The making of the hose for transporting a liquid medium and the mooring line in the form of a single hose-mooring line attached by its bitter end to the device of the fixed construction enables the reliable and high quality single-point mooring and transportation of a liquid medium due to the lack of twisting of the hose and the mooring line and simplified work of a diver with the single hose-mooring line, which contributes to the achievement of a technical result.

Also, the additional use in the method of an ice-breaker ensuring offshore shipping of oil, which has a diving station installed on the deck and communicating with a trunk, as arranged in the hull, for lowering and raise of a diver, enables not only to make the way for a tanker in ice in the winter time to a place of mooring and servicing and continuously clean the latter from ice, but also to ensure lowering and raise of a diver through the ice-breaker trunk. A diver opens a valve, which is arranged on the fixed construction, for a liquid medium for the purpose of transporting it into the tanker. Furthermore, a diver conducts a search and raise of the hose-mooring line detached from the cargo-receiving device of a tanker in emergency situations and in the conditions of close and drifting ice.

The system of single-point mooring of ships, primarily tankers, comprising a fixed construction secured to the sea bed and having a device being connected to it with the possibility of turning around the vertical axis and a valve for a liquid medium, primarily oil, a mooring line and a flexible pipeline for transporting a liquid medium into a moored tanker through the cargo-receiving device of a tanker, ensures single-point mooring of tankers and their servicing for transporting a liquid medium offshore at any time, without depending on the dominating wind in a direction most convenient for a tanker with the possibility of its roundabout turning.

The making of the hose for transporting a liquid medium and the mooring line in the form of a single hose-mooring line attached by its bitter end to the device of the fixed construction prevents the hose and the mooring line twisting, enables to moor a ship economically and reliably and makes possible to load a liquid medium into a tanker.

The provision of the system with a weight secured to the hose-mooring line near its bitter end and with a damper preferably made in the form of a cable and connected on one its end with the device of the fixed construction and on the other end with the weight, and the arrangement of the area of the hose-mooring line, which is between the device of the fixed construction and the weight, outside the area of action of power loads ensures not only the hose-mooring line being on the sea bed in the non-operating condition, but also removal of a maximum power load from the area of the hose-mooring line and its transfer via the damper, preferably made in the form of a cable, and via the device of the fixed construction onto the latter. It contributes to reliable and high-quality single-point mooring of a ship and loading of a liquid medium into the latter, which, in combination with the other features, contributes to the achievement of the technical result.

The provision of the system with an ice-breaker ensuring offshore shipping of oil, which has a diving station installed on the deck and communicating with a trunk, as arranged in the hull, for lowering and raise of a diver, enables not only to make the way for a tanker in ice and continuously clean the a place of mooring and servicing from ice, but also to ensure lowering and raise of a diver through the ice-breaker trunk for the purpose of carrying out underwater technical works. First, a diver opens a valve for a liquid medium on the fixed construction secured to the sea bed. Second, if an emergency situation occurs during transporting oil into a tanker, the hose-mooring line automatically detaches from the cargo-receiving device of the tanker and falls onto the sea bed. After liquidating the emergency situation it is necessary to resume transporting oil into the tanker. For this, with the help of a diver lowered from the ice-breaker the hose-mooring line is found and raised to the tanker, Furthermore, in the conditions of close and drifting ice, when the commonly used raise of the hose-mooring line is impossible, a diver also ensures a search and raise of the hose-mooring line from the sea bed to the tanker.

Thus, the claimed totality of the essential distinctive features of both the method and the system of single-point mooring of ships contributes to the achievement of a new technical result. Consequently, the claimed new totality of the essential features of both the ice-breaker (embodiments) and the method and the system of single-point mooring of ships enables to achieve the stated new technical result—the possibility of offshore shipping of a liquid medium, primarily oil, from the onshore tank farm to sea-going tankers in the winter time in the ice conditions by ensuring both mooring to an offshore terminal and single-point mooring of a tanker at any time, without depending on the dominating wind and sea condition, in a direction most convenient for it with the possibility of its roundabout turning, with the subsequent servicing of it by transporting a liquid medium into such a tanker.

In the course of an information search, which has been conducted by the applicant in this technical field, only individual distinctive features of the claimed inventions have been found among the known facilities of the same purpose, namely:

1. A guiding trunk for servicing a cylinder (see RF Patent No. 2119874), it is identical to the claimed one as to the purpose and the function.
2. A pontoon (see USSR Inventors' Certificates Nos. 1011499, 846498, 618308), but the purpose and the function of the pontoon in these solutions are completely different from those in the claimed invention.
3. A guiding cylinder with guiding members for moving inside a trunk (see RF Application No. 95107661, IPC B63B 22/02, for the invention "A device for directing a subsea loading/unloading buoy into the receiving space in the ship's bottom"). But the function is different from that in the claimed invention.
4. Protection devices (see USSR Inventor's Certificate No. 1751043—in the ship's hull a square hatch is made; USSR Inventor's Certificate No. 1093611—a protective ring). But the form, the purpose and the function of the known protective devices are different from those in the claimed totality of the essential distinctive features.
5. Known in the art are supplying ice-breakers, which are equipped with a towing device and fire-fighting equipment for working offshore (see magazines "Sudostroenie za rubezhom", 1984, No. 5, p. 65; "Morskoy flot", 1999, No. 2, p. 25; "Sudostroenie", 1990, No. 10, p. 3-5).
6. Also known in the art are vertical through guiding trunks made in the hull of an ice-breaker (see USSR Inventor's Certificate No. 1106730 for the invention "An ice-breaker") But, the purpose and the functions of the known trunks are different from those in the claimed solution.

Moreover, no other distinctive features are identified in the state of art; their form, arrangement, ties between members as well as most identified features have another purpose, function and form; also, the totality of the essential distinctive features of the claimed group of inventions has not been found in the course of the search conducted. Thus, on the basis of an analysis of the found information on the state of the art in this field and an analysis of the totality of the essential distinctive features of the claimed group, which are united by the single inventive concept of the inventions, the latter do not obviously follow from the state of the art. Consequently, the claimed group of inventions has the patentability criterion of inventive step.

The claimed group of inventions "An ice-breaker (embodiments), a method and a system of single-point mooring and servicing of ships" is further explained on the drawings, where:

FIG. 1 shows the ice-breaker for offshore shipping of a liquid medium, primarily oil, a side view.

FIG. 2—the same, a top view, a layout of the main deck.

FIG. 3—the same, a top view, a layout of the forecastle deck.

Figure 6:
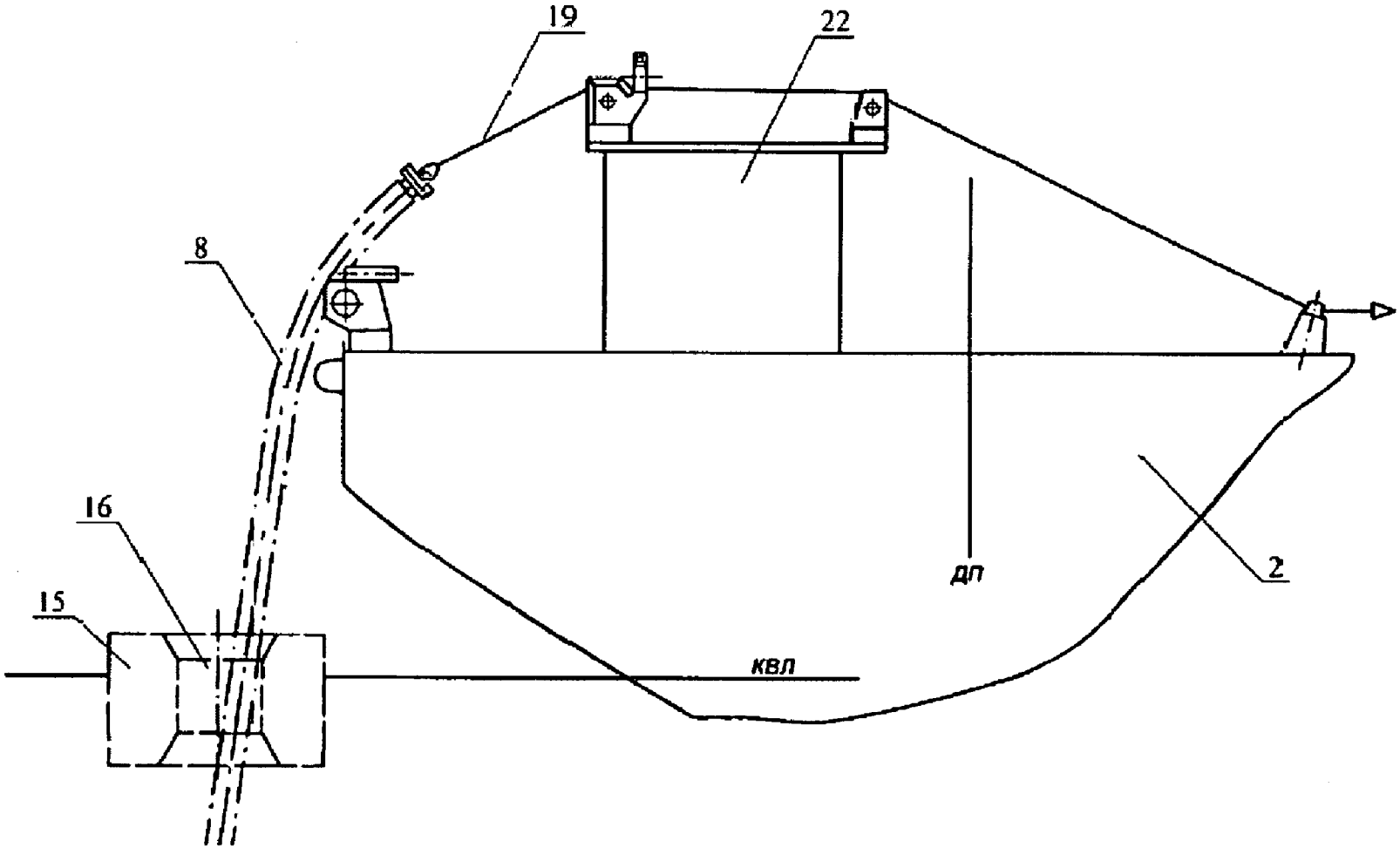
FIG. 6 shows the use of the ice-breaker according to the 2nd embodiment.
Figure 7:
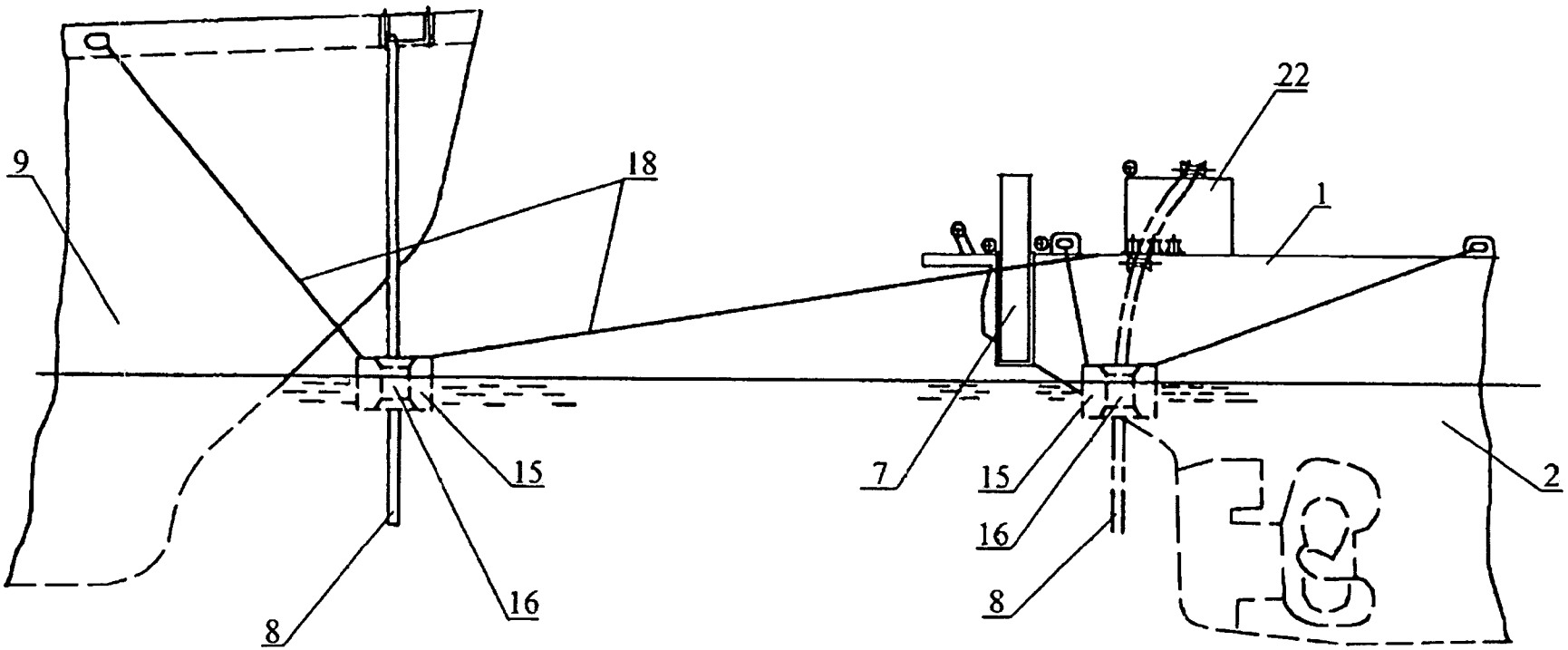

FIG. 7—the same as in FIG. 6, a embodiment of locating the ice breaker at a distance from a tanker.

Figure 8:
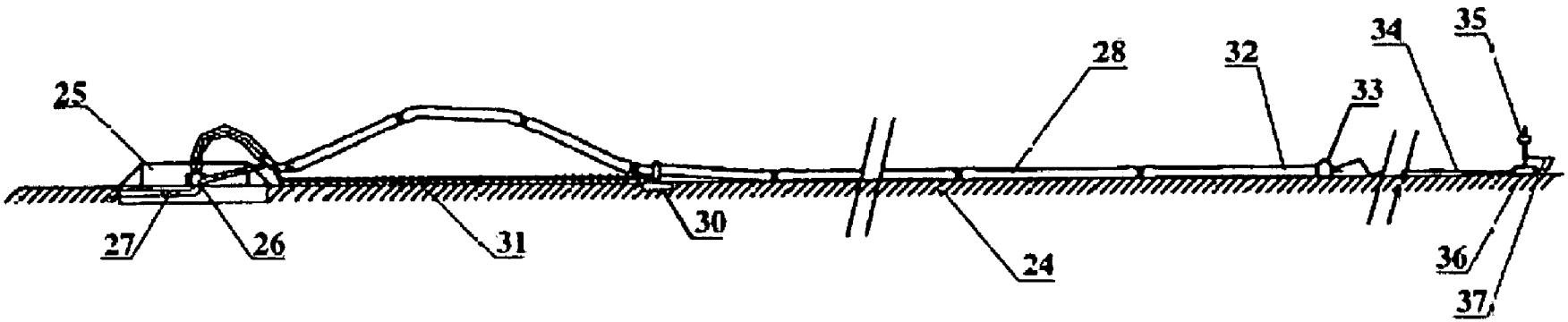

FIG. 8 shows the system of single-point mooring in the initial condition.

Figure 9:
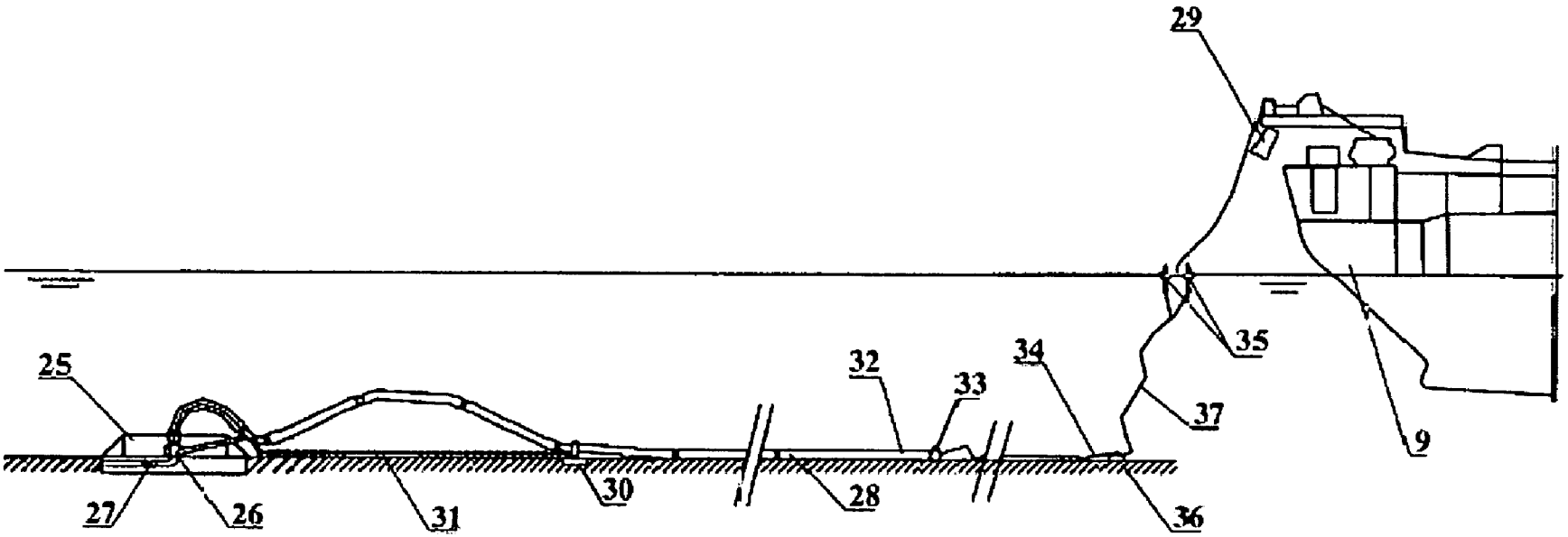

FIG. 9—the same, surfacing of remotely controlled buoys.

Figure 10:
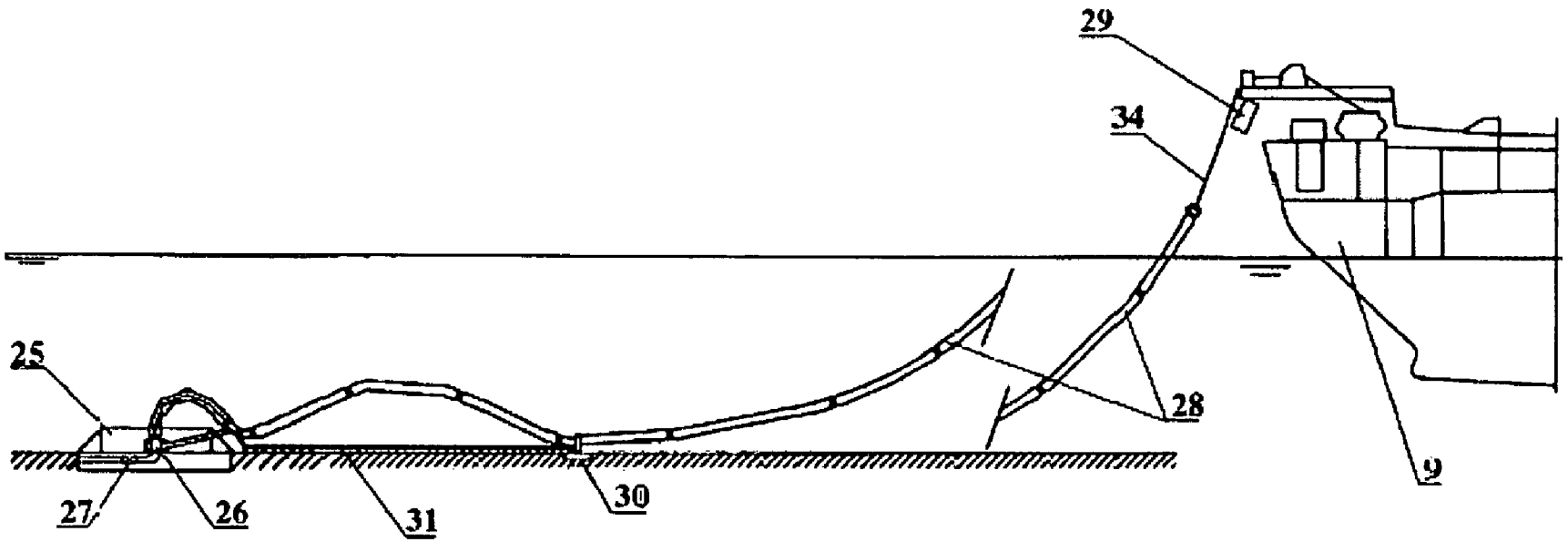

FIG. 10—the same, raising the hose-mooring line.

Figure 11:
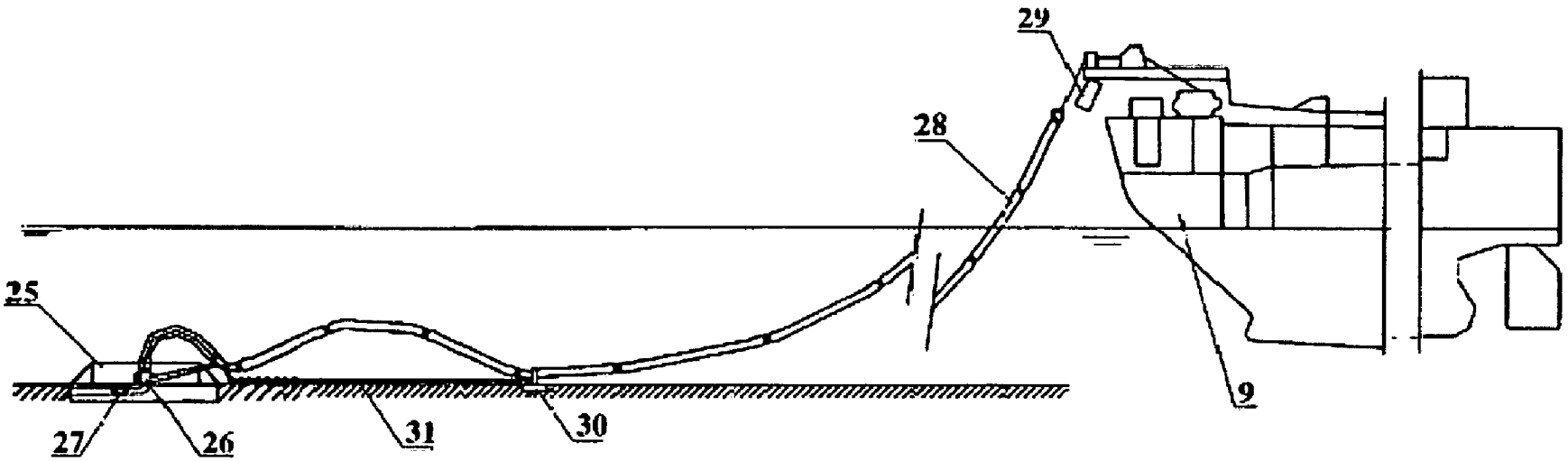

FIG. 11—the same, attaching the hose-mooring line to the cargo receiving device and transporting of a liquid medium.

Figure 12:
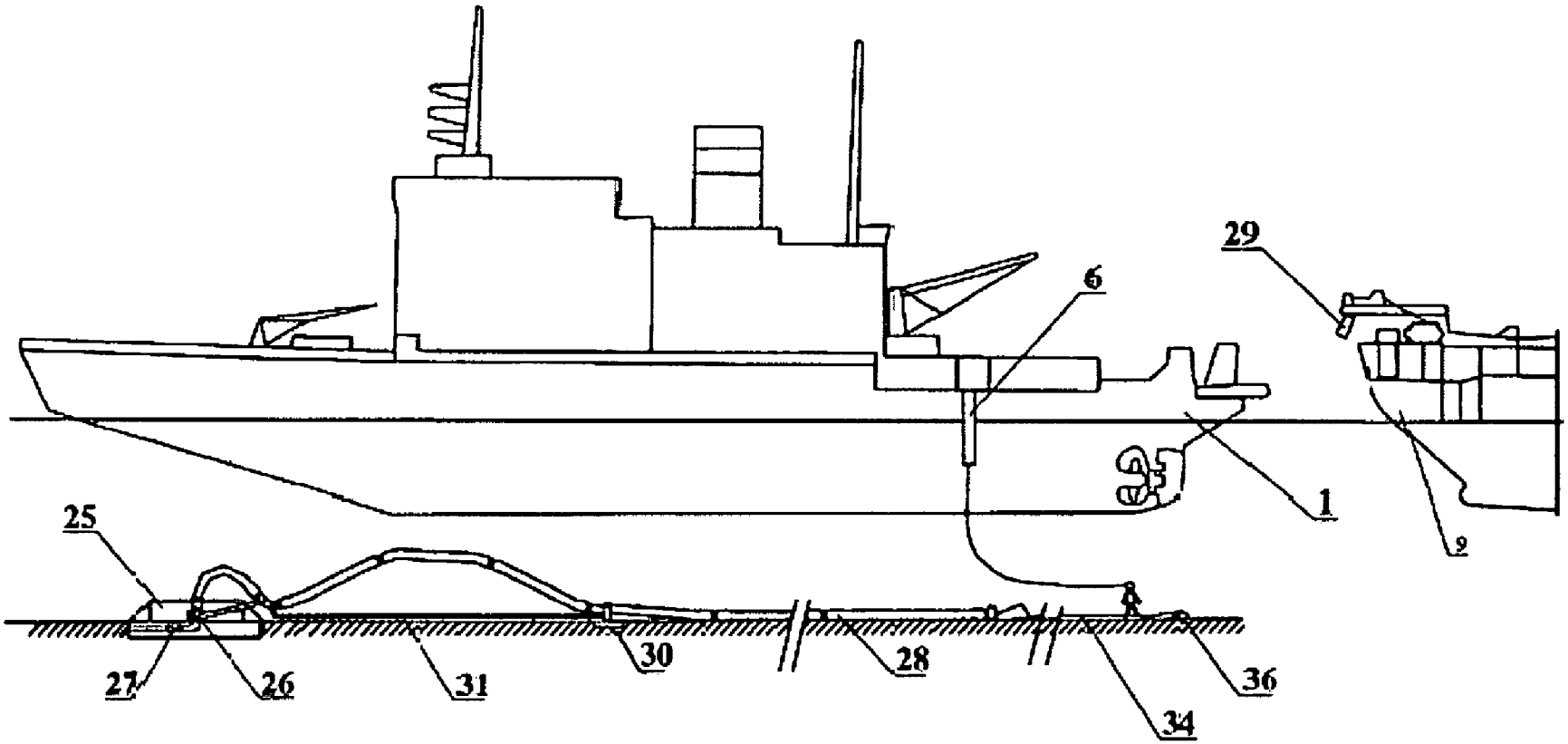

FIG. 12—the same as in FIG. 8, when working in the conditions of drifting ice at the time of searching for the end of the hose-mooring line by a diver.

Figure 1:
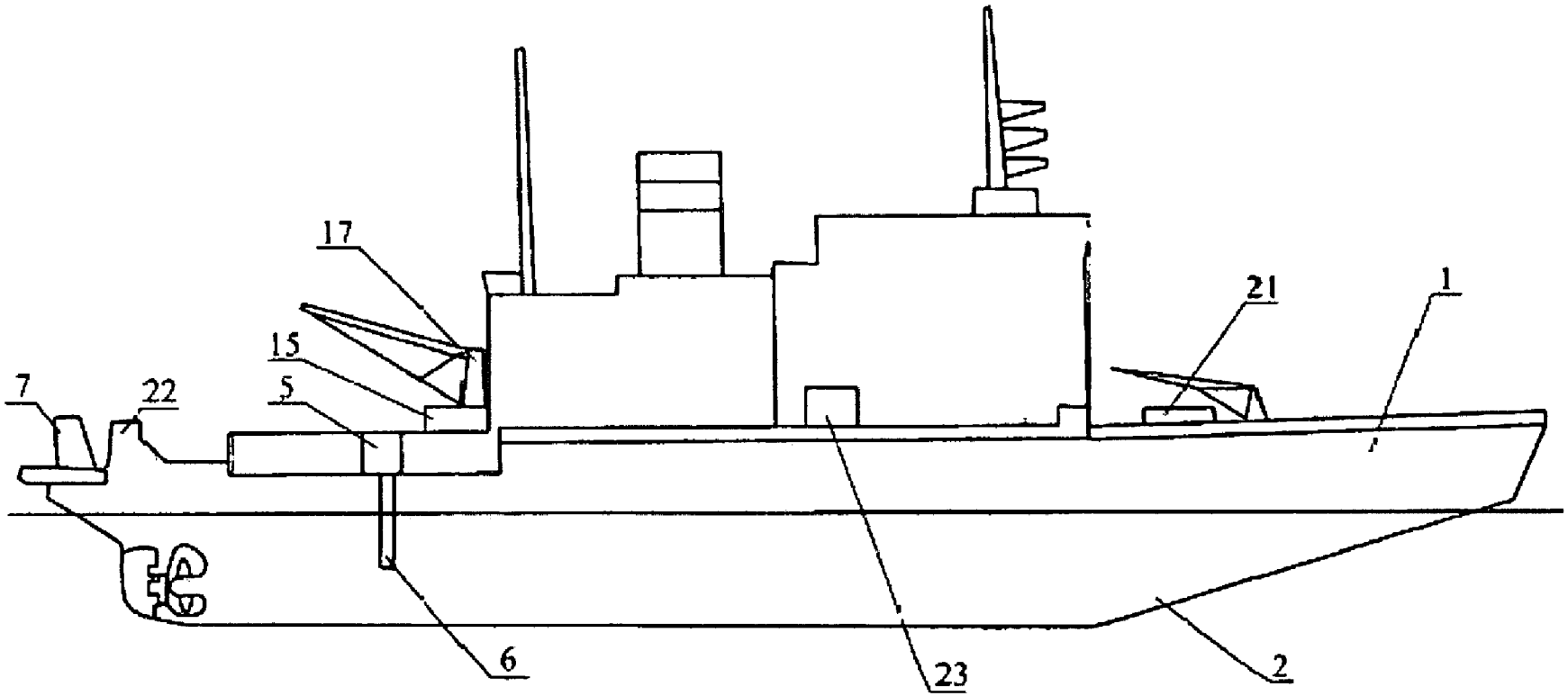
Figure 2:
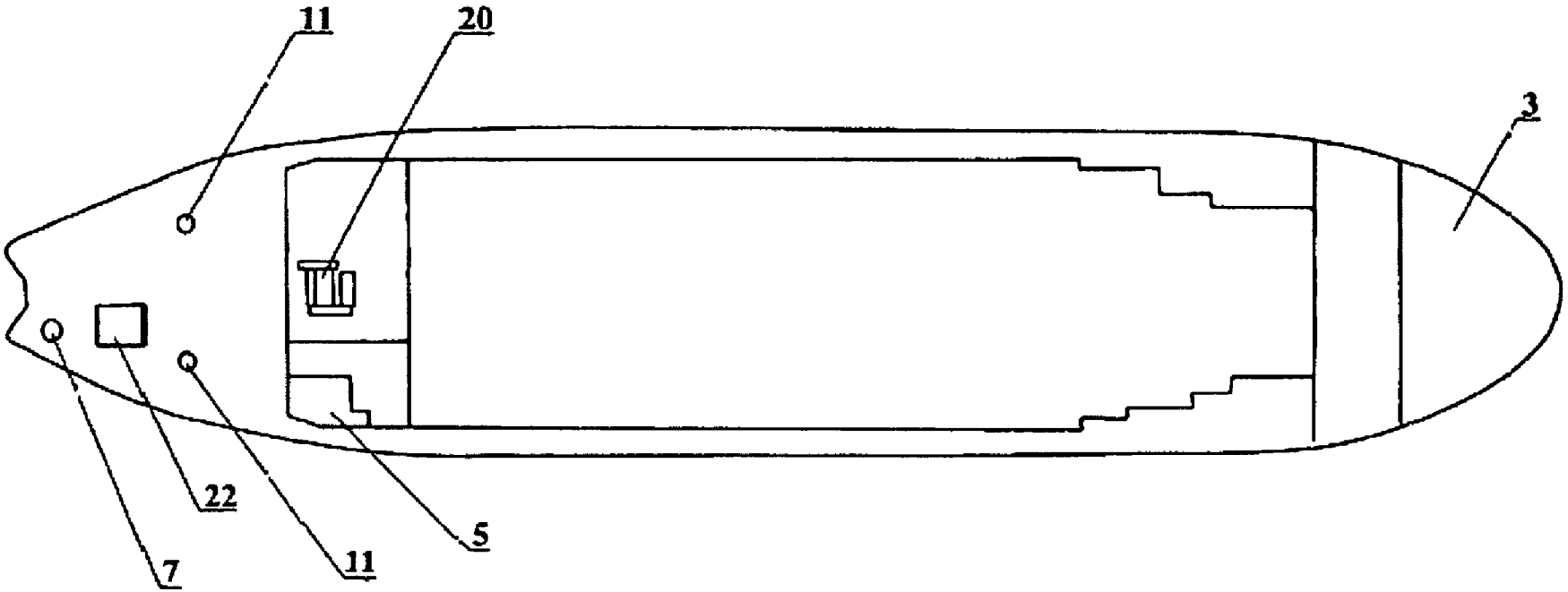
Figure 3:
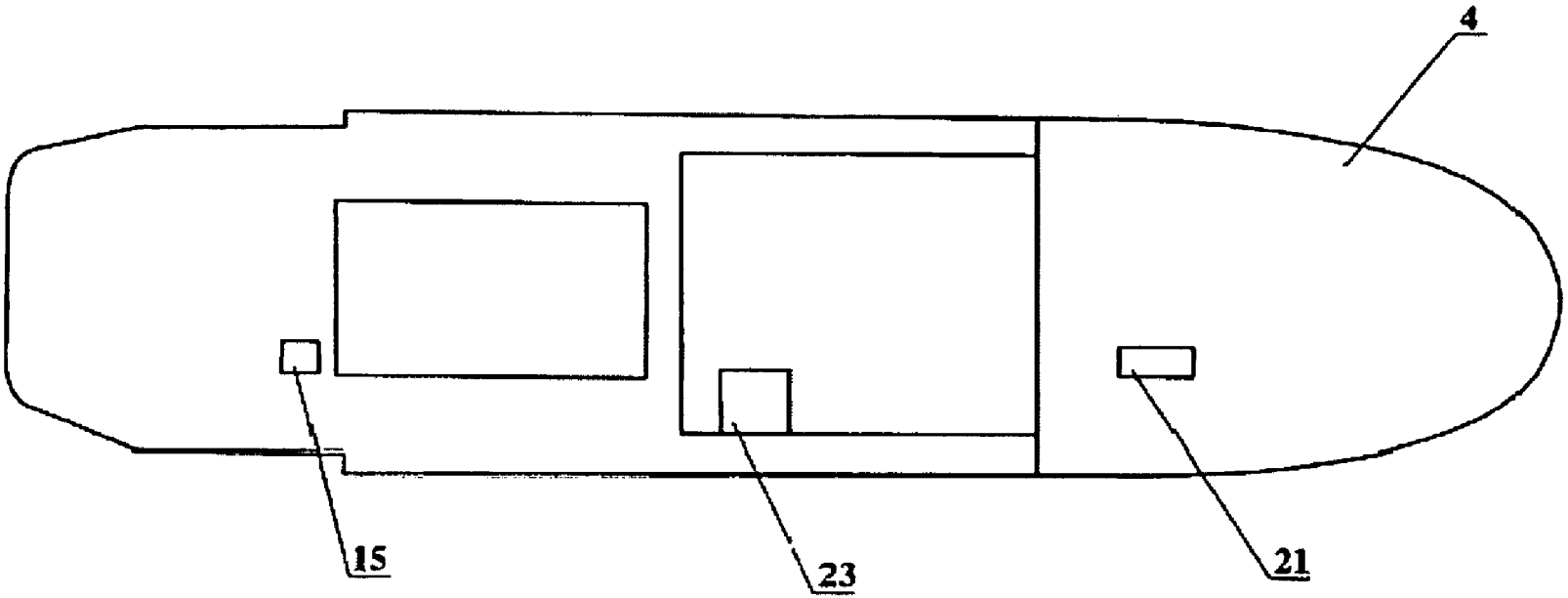

The ice-breaker 1 (see FIG. 1) for offshore shipping of oil comprises the hull 2 with the main deck 3 (see FIG. 2) and the forecastle deck 4 (see FIG. 3). On the deck 3 the diving station 5 is arranged, which is equipped with the diving trunk 6 arranged in the hull 2 of the ice-breaker 1 and intended for lowering and raising a diver.

Figure 4:
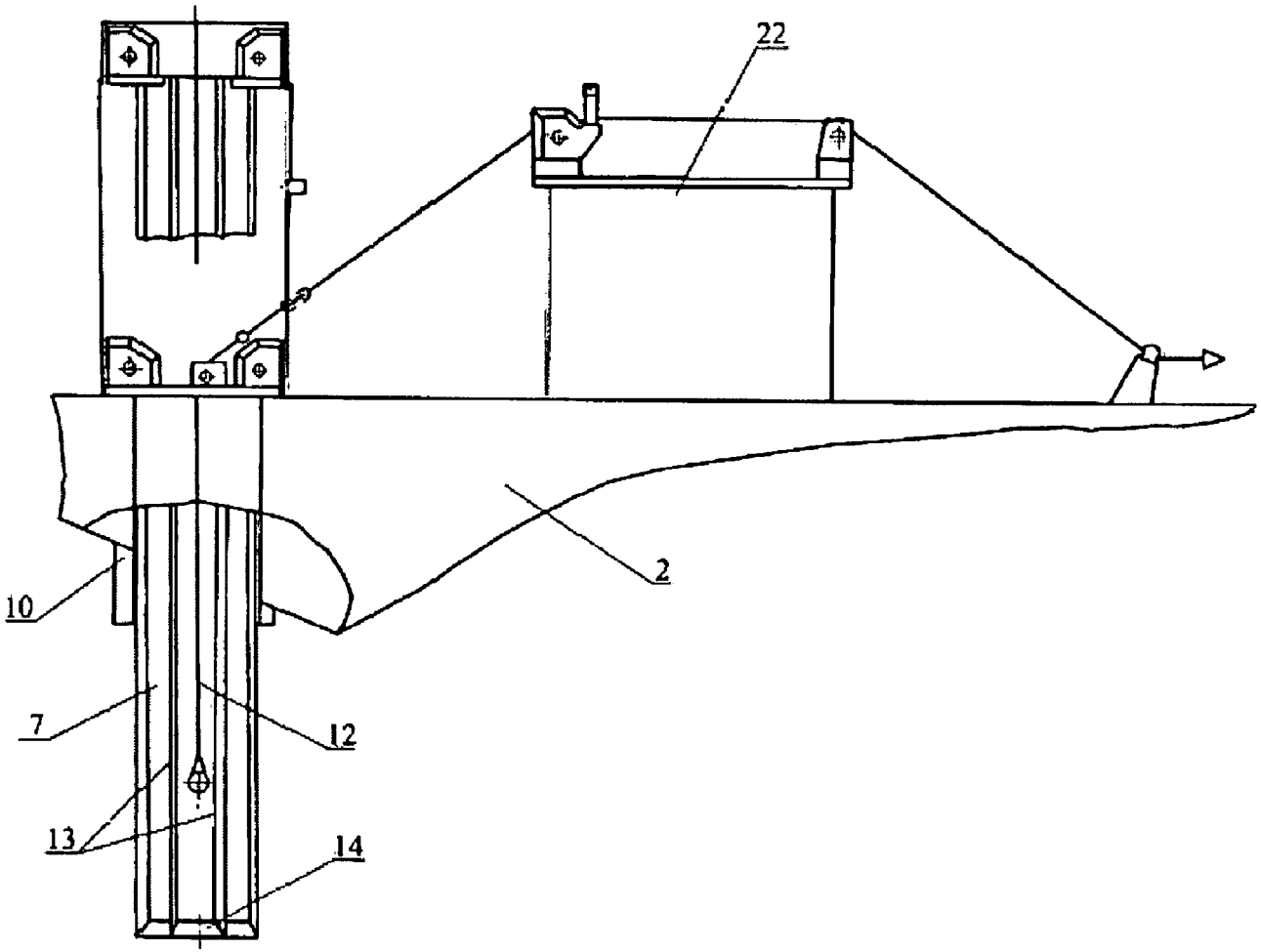
FIG. 4 shows the device for the protection of the flexible hose of the underwater pipeline, which is made in the form of a cylindrical tubule.
Figure 5:
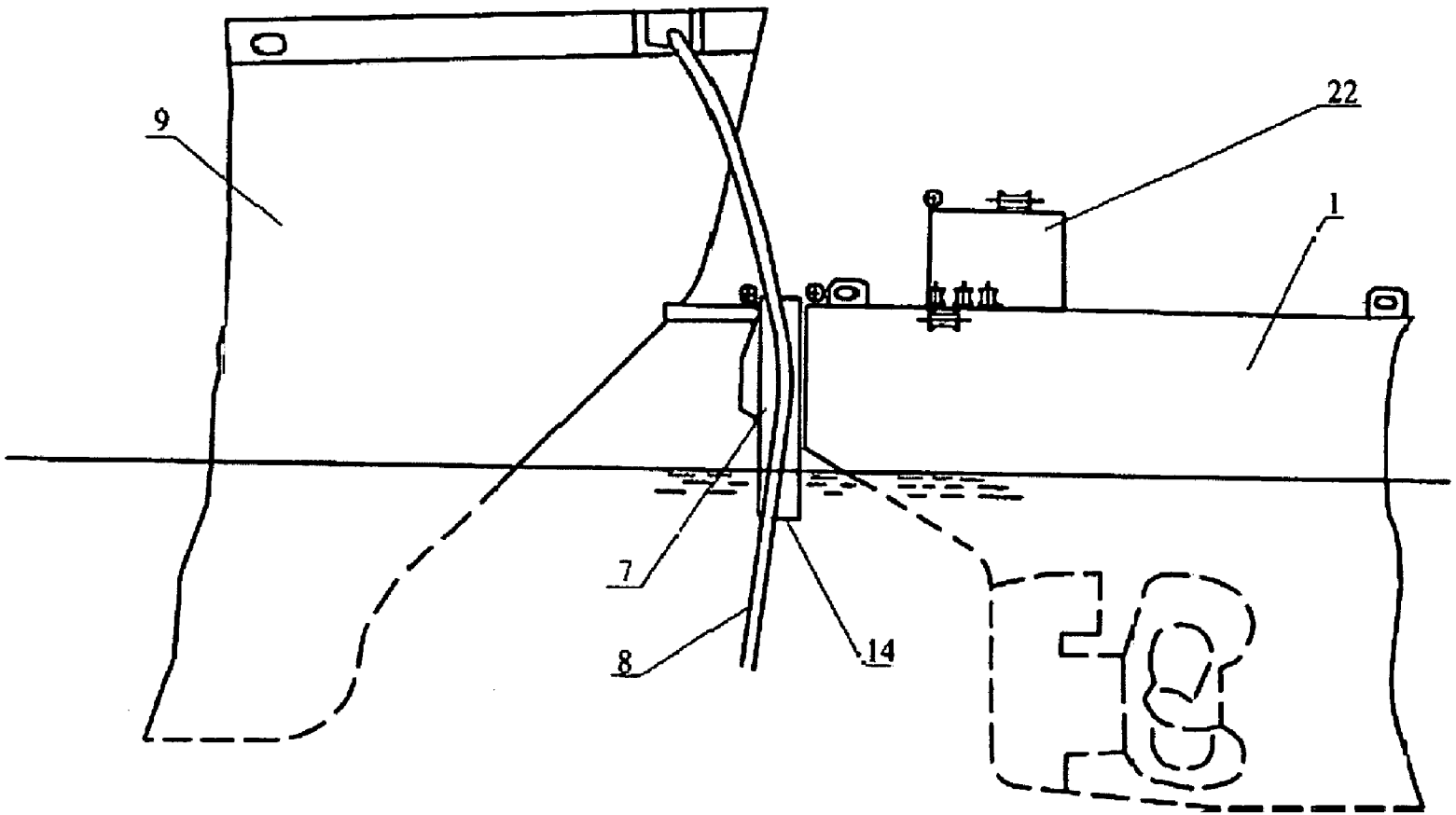
FIG. 5 shows the use of the ice-breaker according to the 1st embodiment.

On the afterdeck 3 the device (see FIGS. 1, 2, 4, 5) is arranged, which is made in the form of the cylindrical tubule 7 and intended to protect the flexible hose 8 of the underwater pipeline with the valve (not shown) against ice action during lowering/raising operations and in the process of oil transporting from the pipeline via the hose 8 into the tanker 9. In the hull 2 of the stem side of the ice-breaker 1 the vertical through guiding trunk 10 is arranged for servicing the cylindrical tubule 7. On the deck 3 of the ice-breaker 1, in its stem side the lowering/raising mechanism made is arranged, which is made in the form of the capstan 11 (see FIG. 2) with the cable 12, the latter being able to pass through the truck 10 for servicing the tubule 7. The latter is provided with the guides 13 for making its movements in the trunk 10 possible. In the travel position the tubule 7 is arranged and secured in the afterdeck 3 of the ice-breaker 1 (see FIG. 4) and in the operation position the tubule 7 is lowered through 10 so as its lower edge 14 is located below the base of floating ice at 0.5 m or 2 m lower than the constructive waterline (CWL) of the ice-breaker 1.

According to the second embodiment of the invention the ice-breaker 1 is equipped with the device for the protection of the flexible hose 8, which is made in the form of the pontoon 15 (see FIGS. 3, 6, 7) having in its central portion the trunk 16 for servicing the hose 8, while the said pontoon is arranged in the travel position on the deck 4 of the ice-breaker 1. The pontoon 15 is made, according to one of the embodiments, rectangular, in the form of a welded steel structure. In order to ensure the required draft (app. 2 m), the lower portion of the pontoon 15 is made permeable for filling it with air or water through the corresponding holes. For lowering onto the water and raising the pontoon 15 to the deck 4 the ship cargo crane 17 is installed on the latter. The expansion—mooring of the pontoon 15 to the ice-breaker 1 and the tanker 9 is made with the use of the cables 18. The flexible hose 8 is raised from the sea bed through the tubule 7 or the trunk 16 of the pontoon 15 with the use of the capstan 11 and the lifting cable 19 (see FIG. 6).

For towing, e.g., towing the tanker 9, which is unable to move, the ice-breaker 1 is equipped with the towing device 20 (see FIG. 2).

On the deck 4 of the ice-breaker 1 the container 21 is installed (see FIG. 3) with oil gathering equipment (not shown) arranged in it and intended for liquidating emergency spills of oil.

The ice-breaker 1 is also provided with the necessary fire-fighting means (not shown) for liquidating possible fires, e.g., foam extinguishers and carbon dioxide fire extinguishers, mobile and emergency fire pumps, a set of fire-fighting tools and outfit.

On the afterdeck 3 of the ice-breaker 1 the removable platform 22 (see FIGS. 1, 2, 4, 5, 6, 7) is installed, on which a container (not shown) is arranged for the purpose of gathering possible spills of a liquid medium, primarily oil, when transporting the latter from the ice-breaker 1 into the tanker 9. It helps to avoid pollution of the environment.

On the deck 4 the ecological monitoring laboratory 23 is arranged with the necessary equipment and instruments. It enables to obtain necessary data on the effect of the oil shipping and transporting activities on the environment, develop efficient measures for reducing negative effects, timely identify oil leakages, provide information support when localizing oil spills.

The ice-breaker 1 for oil shipping operates in the following way.

The ice-breaker 1 comes to the area where the underwater pipeline with the flexible hose 8 is located, making the way in the ice for the tanker 9. According to this embodiment of using the ice-breaker 1 an offshore terminal is provided for mooring of the ice-breaker 1. Then the tanker 9 is moored to the ice-breaker 1 either directly, or at a distance. After finishing the mooring operations, the ice-breaker 1 is preparing for raising the flexible hose 8 of the underwater pipeline. For this purpose a diver is lowered in a cage from the diving station 5 through the diving trunk 6. The diver searches for the flexible hose 8, which is on the sea bed, attaches the hose 8 to the lifting cable 19 and opens the valve on the underwater pipeline.

According to the first embodiment of the ice-breaker 1, the tubule 7 is used in the conditions of finely broken ice having the thickness not more than 1.5 m.

On the afterdeck 3 the tubule 7 is secured. The cable 12 of the capstan 11 is attached to the tubule 7, and the latter is lowered along the guides 13 into the trunk 10 so as its lower edge 14 is below the base of floating ice, by 0.5 m or 2 m lower than the CWL of the ice-breaker 1. After finding the hose 8 the dicer attaches the latter to the lifting cable 19. With the use of the capstan 11 the hose 8 is drawn through the tubule 7 onto the afterdeck 3 of the ice-breaker 1 for equipping the hose with the means necessary for oil shipping. During these operations the hose 8, owing to the tubule 7, does not contact with ice, which prevents it from being damaged. The tubule 7 will be in the operation position until the loading works on the tanker 9 are finished.

According to the second embodiment of the claimed invention the hose 8 is lowered and raised and oil is shipped with the use of the pontoon 15 lowered from the deck 4 of the ice-breaker 1 through the trunk 16 that protects the hose 8 of the underwater pipeline against floating ice during lowering and raising the hose 8 from the sea bed during oil shipping also. The pontoon 15 may be used in the conditions of finely broken ice with the thickness not more than 15 cm.

The pontoon 15 is lowered onto the water with the use of the ship cargo crane 17 of the ice-breaker 1. The pontoon 15 is moved, either with the use of a service boat of the ice-breaker 1 or with the use of the mooring mechanisms of the tanker 9 and the ice-breaker 1, to the area where the hose 8 of the underwater pipeline comes out of the water. The hose 8 is passed through the trunk 16 of the pontoon 15 with the help of a diver, when the capstan 11 with the cable 19 is operated, attaching the latter to the hose 8. Then, the hose 8 is raised onto the afterdeck 3 of the ice-breaker 1 for the purpose of equipping it with the means necessary for shipping oil (it is provided for when the tanker 9 is positioned directly to the stem of the ice-breaker 1.

In a case where the tanker 9 is positioned at a distance from the ice-breaker 1 (see FIG. 7) by a service boat or with the use of the mooring mechanisms of the ice-breaker 1 and the tanker 9, the pontoon 15 together with the hose 8 are transported to the tanker 9. The pontoon 15 is moored to the tanker 9 or the ice-breaker 1 with the cables 18. Then, the oil sipping operations are performed.

The ice-breaker 1, which is claimed as an invention, enables to carry out works on offshore shipping of oil into the tanker 9 not only in the conditions of initial ice formation, but also in the conditions of stable fast ice. The ice-breaker 1, independently making a passage in the ice for itself or, when necessary, going after a line nuclear-powered ice-breaker, e.g., of Taimyr type, comes to the area of the underwater pipeline and is fixed with the use of ice anchors. The tanker 9 comes along the passage to the ice-breaker 1 and is fixed in the ice passage. Then, the operations on lowering and raising the tubule 7 (or the pontoon 15), raising the hose 8 of the underwater pipeline and oil shipping are carried out as described above.

Thus, the use of the ice-breaker 1, which is claimed as an invention, enables not only to ensure offshore shipping of oil from an onshore tank farm into sea-going tankers in the winter time in the ice conditions, but also, in the result of using the claimed ice-breaker, new functions, not peculiar to an ice-breaker, but necessary for safe shipping of oil, are performed, namely: liquidation of emergency oil spills, liquidation of fires, prevention of the environment in the area of oil shipping from being polluted.

The preferred embodiment of the system of single-point mooring and servicing of ships, primarily tankers 9, is shown in FIGS. 8, 9, 10, 11, 12.

The system comprises the fixed construction 25 secured to the sea bed 24 (see FIGS. 8, 9), which has the rotating device 26 connected with the construction with the possibility of turning around the vertical axis, the valve 27 for a liquid medium, primarily oil, the hose-mooring line 28 for mooring the tanker 9 and transporting oil from the underwater pipeline into the tanker 9 through the cargo-receiving device 29, e.g., a bow receiving device, of the tanker, the weight 30 secured to the hose-mooring line 28, the damping cable 31 connected on one its end to the rotating device 26 and on the other end to the weight 30. The hose-mooring line 28 is secured, by its bitter end, to the rotating device 26 of the fixed construction 25. The fast line 32 of the hose-mooring line 28 is provided with the head 33, which is necessary for connection to the cargo receiving device 29 of the tanker 9, and the guiding cable 34 connected to the remotely operated buoys 35 taken. e.g., in the quantity of two pieces. The buoys 35 are equipped with the anchoring weight 36 necessary for positioning the fast line 32 of the hose-mooring line 28, when in the non-operative position, on the sea bed 24. The buoys 35 are connected to the anchoring weight 36 by the cable 37.

The availability of the damping cable 31, which is connected on its one end to the rotating device 26 and on the other end to the weight 30, in the system and positioning of the section of the hose-mooring line 28, being between the rotating device 26 and the weight 30, outside the area of power load action enables to remove the maximum load from the section of the hose-mooring line and transfer it via the damping cable 31 and the rotating device 26 to the fixed construction 25. It helps to avoid possible breakages of the hose-mooring line 28 during single-point mooring of the tanker 9.

For the purpose of quickly finding the system of single-point mooring its individual members are equipped with radio receivers and radio transmitters (not shown). The latter are arranged at the fixed construction 25, the weight 30, the head 33 and in the buoys 35. The moored tanker 9 is equipped with a system (not shown) for automatically pulling the hose-mooring line 28. The cargo receiving device 29 of the tanker 9 and the head 33 of the hose-mooring line 28 are equipped with means (not shown) for automatically disconnecting the hose-mooring line 28 from the cargo receiving device 29 of the tanker 9, which are necessary in a case of emergency.

The system of single-point mooring is provided with the ice-breaker 1 (see FIGS. 1, 2) for offshore shipping of oil, which has the diving station 5, as installed on the deck 3, with the diving trunk 6 for lowering and raising a cage with a diver, who is to open the valve 27 for a liquid medium at the fixed construction 25 as well as find and raise the hose-mooring line 28 after its emergency detachment from the cargo receiving device 29 of the tanker 9 in the conditions of close and drifting ice also.

The method of single-point mooring of the tanker 9 is carried out as follows.

To the location of the fixed construction 26 with the hose-mooring line 28 the ice-breaker 1 comes first, making the way in the ice for the tanker 9. With the use of radio receivers of the ice-breaker 1 or the tanker 9, which are capable of receiving signals from radio transmitters arranged at the fixed construction 25, the weight 30, the head 33 of the hose and the buoys 35, the exact location of the hose-mooring line 28 is determined. Apart from this, the ice-breaker 1 continuously clean the place of mooring of the tanker 9 from ice.

A control signal is sent from the tanker 9 to the remotely operated buoys 35, which forces the buoys 35 to automatically disconnect themselves from the anchoring weight 36, the cable 37 unwinds, thus enabling the buoys 35 to come to the surface. The buoys 35 are caught from the tanker 9 by a known method and raised onboard, then the guiding cable 35 is caught, which is winded on the winch drum and disconnected from the hose-mooring line 28 just after connecting the head 33 to the bow cargo receiving device 29 of the tanker 9.

It should be mentioned at this point that the system enables to moor the tanker 9 at any time, without depending on the dominating wind direction and sea condition, in the direction most convenient for it with the possibility of turning the tanker 9 roundabout. The possibility of twisting the hose-mooring line 28 is fully avoided.

A diver in a cage is lowered from the ice-breaker 1 through the diving trunk 6 from the diving station 5, who opens the valve 27 for a liquid medium at the fixed construction 25. Then the diver in the cage is raised onboard the ice-breaker 1. The latter continues cleaning the place of mooring and servicing of the tanker 9 from ice.

During the operation of oil shipping into the tanker 9 the tension of the hose-mooring line 28 is monitored automatically. As soon as the tension exceeds the allowable norm (in emergencies)., the means for automatically disconnecting the hose-mooring line 28 from the cargo receiving device of the tanker 9 act. The hose-mooring line 28 falls on the sea bed 24. The guiding cable 34 remains winded on the winch drum on the tanker 9. After liquidating the emergency a diver again is lowered from the ice-breaker 1 through the trunk 6, who finds the hose-mooring line 28 and connects the guiding cable 34 with the buoys 35 to it. Then everything is repeated according to the above described procedure.

Apart from this, in the conditions of close and drifting ice, which frequently take place in Arctic seas, when it is impossible to raise the hose-mooring line 28 by the above described method, a diver is lowered through the diving trunk 6 of the ice-breaker 1, who connects the lifting cable 19 to the hose-mooring line 28, thus helping to raise the hose-mooring line 28 from the sea bed 24 onboard the ice-breaker 1 and transfer it to the tanker 9.

It should be mentioned that in liquidating emergencies, in particular a fire, a local oil spill, towing of the tanker 9 unable to move, the ice-breaker 1 for offshore shipping of oil directly participates, owing to the special equipment available onboard.

Thus, in the result of using this group of inventions, a new technical result is achieved—the possibility of offshore shipping of a liquid medium, primarily oil, from an onshore tank farm into sea-going tankers in the winter time in the ice conditions by ensuring both mooring to an offshore terminal and single-point mooring of a tanker at any time, without depending on the dominating wind and sea condition, in a direction most convenient for it with the possibility of its roundabout turning, with the subsequent servicing of it by transporting a liquid medium into such a tanker.

Consequently, the claimed group of inventions complies with the patentability criterion of industrial applicability.

By the present time the method of single-point mooring of tankers and the system for carrying out same with the use of the claimed ice-breaker based on additionally equipped ice-breaker Captain Nikolaev have passed tests in the Barents Sea in the Timano-Pechora region; the tests have shown the possibility of the single-point mooring and oil shipping in the winter time in the ice conditions.

The invention claimed is:

1. An ice-breaker, primarily for carrying out offshore shipping of a liquid medium, comprising a hull with vertical through guiding trunks and a deck, characterized in that it is equipped with a diving station installed on the deck and communicating with one of the said vertical through trunks, the said one trunk being intended for lowering and raising a diver, a device for the protection of a flexible hose of an underwater pipeline against ice action, the said device being made in the form of a cylinder provided with guides for moving in another vertical trunk made in the stern side of the hull and installed in its travel position on the afterdeck.

2. The ice-breaker according to claim 1, characterized in that it is equipped with cargo lowering and lifting mechanisms and a towing device.

3. The ice-breaker according to claim 1, characterized in that it is equipped with a container, which is installed on the deck and contains oil gathering equipment and fire-fighting means.

4. The ice-breaker according to claim 1, characterized in that it is equipped with a removable platform, which is installed on the afterdeck and has a container for gathering oil spills and an ecological monitoring laboratory.

5. An ice-breaker, primarily for carrying out offshore shipping of a liquid medium, comprising a hull with a vertical through guiding trunk and a deck, characterized in that it is equipped with a diving station installed on the deck and communicating with the said vertical through trunk being intended for lowering and raising a diver, a device for the protection of a flexible hose of an underwater pipeline against ice action, said device being made in the form of a pontoon having a trunk for servicing of a flexible hose and installed in its travel position on the deck.

6. The ice-breaker according to claim 5, characterized in that it is equipped with cargo lowering and lifting mechanisms and a towing device.

7. The ice-breaker according to claim 5, characterized in that it is equipped with a container being installed on the deck and contains oil gathering equipment and fire-fighting means.

8. The ice-breaker according to claim 5, characterized in that it is equipped with a removable platform, which is installed on the afterdeck and has a container for gathering oil spills and an ecological monitoring laboratory.

9. A method of single-point mooring and servicing of ships, in ice conditions, according to which a fixed construction secured to the sea bed is used, the said construction being provided with a device being connected to it with the possibility of turning around the vertical axis and a valve for a liquid medium, primarily oil, a mooring line and a flexible pipeline for transporting a liquid medium into a moored tanker through a cargo-receiving device of the tanker, characterized in that for mooring a tanker and transporting a liquid medium a mooring line and a hose that are made as a single hose-mooring line which bitter end is secured on the fixed construction device, are used, an ice-breaker ensuring offshore shipping of oil is additionally used, the said ice breaker being equipped with a diving station installed on the deck and communicating with a trunk for lowering and raising a diver, who opens the valve for a liquid medium, finds the hose-mooring line and raises it to the tanker after emergency detachment of it from the cargo-receiving device of the tanker in the conditions of close and drifting ice.

10. The method according to claim 9, characterized in that a weight is attached to and a damper being made, preferably, in the form of a cable and connected on one its end with the device of the fixed construction and on the other end with the said weight, is installed on a section of the hose-mooring line near its bitter end.

11. The method according to claim 9 or claim 10, characterized in that a section of the hose-mooring line, which is located between the device of the fixed construction and the weight, is installed outside the area of action of power loads.

12. A system of single-point mooring of ships, in ice conditions, comprising a fixed construction secured to the sea bed and having a device being connected to it with the possibility of turning around the vertical axis and a valve for a liquid medium, primarily oil, a mooring line and a flexible pipeline for transporting a liquid medium into a moored tanker through a cargo-receiving device of the tanker, characterized in that the mooring line and the hose for transporting a liquid medium are made as a single hose-mooring line which bitter end is secured on the fixed construction device; the system is provided with an ice-breaker ensuring offshore shipping of oil, which has a diving station installed on the deck and communicating with a trunk, arranged in the hull, for lowering and raising a diver, who opens the valve for a liquid medium, finds and raises the hose-mooring line after emergency detachment of it from the cargo-receiving device of the tanker in the conditions of close and drifting ice.

13. The system according to claim 12, characterized in that it is provided with a weight is attached to the hose-mooring line near its bitter end and a damper being made, preferably, in the form of a cable and connected on one its end to the device of the fixed construction and on the other end to the said weight.

14. The system according to claim 12 or claim 13, characterized in that a section of the hose-mooring line, which is located between the device of the fixed construction and the weight, is outside the area of action of power loads.

* * * * *